United States Patent [19]

Madgavkar et al.

[11] 4,366,668

[45] * Jan. 4, 1983

[54] SUBSTOICHIOMETRIC COMBUSTION OF LOW HEATING VALUE GASES

[75] Inventors: Ajay M. Madgavkar, Irvine, Calif.; Roger F. Vogel, Butler; Harold E. Swift, Gibsonia, both of Pa.

[73] Assignee: Gulf Research & Development Company, Pittsburgh, Pa.

[ * ] Notice: The portion of the term of this patent subsequent to Mar. 4, 1997, has been disclaimed.

[21] Appl. No.: 238,032

[22] Filed: Feb. 25, 1981

[51] Int. Cl.[3] ..... F02C 3/22

[52] U.S. Cl. ..... 60/39.06; 60/39.46 G; 60/723; 423/245; 423/247; 423/248

[58] Field of Search ..... 60/39.06, 39.46 G, 723; 431/10; 423/245, 247, 248

[56] References Cited

U.S. PATENT DOCUMENTS

| | | | |
|---|---|---|---|
| 3,731,485 | 5/1973 | Rudolph et al. | 60/39.12 |
| 3,928,961 | 12/1975 | Pfefferle | 60/723 |
| 3,982,879 | 9/1976 | Pfefferle | 431/10 |
| 4,054,407 | 10/1977 | Carrubba et al. | 431/10 |
| 4,191,733 | 3/1980 | Swift et al. | 423/247 |
| 4,299,086 | 11/1981 | Madgavkar et al. | 60/39.06 |

*Primary Examiner*—Robert E. Garrett

*Attorney, Agent, or Firm*—Deane E. Keith; Forrest D. Stine; Donald L. Rose

[57] ABSTRACT

The combustible component of a stream of low heating value gas comprising carbon monoxide, hydrogen and methane is combusted using less than a stoichiometric amount of air in the presence of an oxygenation catalyst and the heat energy in the combusted gas is utilized, for example, by expansion in a gas turbine.

17 Claims, No Drawings

SUBSTOICHIOMETRIC COMBUSTION OF LOW HEATING VALUE GASES

SUMMARY OF THE INVENTION

This invention relates to the catalyzed combustion of combustible, low heating value gases comprising carbon monoxide, hydrogen and methane using less than a stoichiometric amount of oxygen and to the utilization of the heat energy in the combusted gas stream, such as by expansion in a gas turbine, and discharging the incompletely combusted gas stream into the atmosphere.

DETAILED DESCRIPTION OF THE INVENTION

Hydrocarbon vapors and gases of high heating value have for centuries been burned as a source of energy for heating purposes or as a source of motive power for driving machinery. Such combustion is purposely carried out with sufficient air to accomplish complete combustion of the hydrocarbon gas to carbon dioxide and water in order to full utilize the heat energy available in the fuel.

In contrast, gas streams of low heating value containing a mixture of combustible and inert gases, such as waste gas streams, have traditionally been discharge to the atmosphere. In recent years a greater recognition and concern about atmospheric pollution has led to legal standards controlling the direct emission to the atmosphere of gas streams containing significant amounts of hydrocarbons and/or carbon monoxide. In order to avoid atmospheric pollution, the hydrocarbon components and carbon monoxide in a waste gas stream of low heating value are generally combusted in the presence of an oxidation catalyst to carbon dioxide and water using a stoichiometric excess of oxygen before venting the gas to the atmosphere. Examples of this procedure are numerous in the various manufacturing and industrial arts.

In recognition of the fact that a large amount of energy is contained in a large volume of low heating value gas, it has occasionally been suggested that gas streams of low heating value be stoichiometrically combusted and the energy be removed to a boiler or in a turbine before venting to the atmosphere. U.S. Pat. Nos. 2,449,096; 2,720,494; 2,859,954; 3,928,961 and 4,054,407 are examples of this latter concept of completely burning residual combustibles in a low heating value or waste gas stream and recovering energy from the combusted gas stream before it is vented to the atmosphere. However, the useful arts do not appear to contemplate the intentional partial combustion of a gas stream of low heating value with energy recovery prior to venting the partially combusted gas stream to the atmosphere.

In order to oxidize the combustible portion in a low heating value gas stream, such as a mixture of hydrogen, carbon monoxide and/or gaseous paraffins and nitrogen, with a stoichiometric or excess amount of air, a suitable oxidation catalyst is required. A platinum-base catalyst is generally considered to be the most effective catalyst for this oxidation. In order for combustion to be initiated and to continue after ignition, the low heating value gas stream must be heated to its ignition, or light-off, temperature prior to contacting the gas stream with the oxidation catalyst. This light-off temperature is a variable which depends on the particular composition of the gas undergoing combustion as well as on the particular catalyst being used. When the catalyst is provided in a suitable physical form to provide adequate contact of the gas with the catalyst, substantially complete combustion of the hydrocarbon to carbon dioxide and water is accomplished. In contrast, combusting a diluted gas stream of low heating value in contact with a platinum oxidation catalyst and an insufficient, that is substoichiometric, amount of air cannot result in complete combustion of the combustible component.

We have found that the combustible component in a low heating value gas, comprising a mixture of hydrogen, carbon monoxide, methane and higher aliphatic hydrocarbons, can be partially combusted in a catalytic combustion procedure using less oxygen than that required to convert all combustibles to carbon dioxide and water. But more significantly we have discovered under these conditions, including a low heating value gas, catalyzed combustion and substoichiometric combustion, that there is an order of preferential combustion in which hydrogen, carbon monoxide and the aliphatic hydrocarbons higher than methane are preferentially combusted before methane. Since methane is not regarded as a pollutant when discharged into the atmosphere in moderate quantities, it is fortuitous that the carbon monoxide and higher aliphatic hydrocarbon pollutants are preferentially combusted so that the partially combusted gas stream, containing methane as its primary combustible component, can be directly vented to the atmosphere.

As a demonstration of this variable combustibility, a nitrogen-diluted two weight percent mixture of one to five carbon paraffinic hydrocarbons was burned in a combustion furnace with fifty percent of the stoichiometric amount of air for complete combustion. The gas, heated to 840° F. and passed in contact with a supported platinum oxidation catalyst, reached a maximum temperature of 1430° F. In this combustion experiment 100 percent of the n-pentane was converted, 54.5 percent of the n-butane, 44.1 percent of the propane, 31.8 percent of the ethane and 11 percent of the methane. This demonstrates that partial combustion of a gaseous hydrocarbon mixture including methane will substantially increase the proportion of methane in the product gas. We have discovered a similar order of preferred combustion in comparing the catalyzed substoichiometric combustion of hydrogen and carbon monoxide with methane in a low heating value gas. This benefit is particularly marked when methane is a significant portion of the combustible component of the low heating value gas stream, since carbon monoxide and the higher hydrocarbons can be preferentially eliminated even though there is incomplete combustion.

The low heating value gas streams which are substoichiometrically combusted by our process contain a significant quantity of methane in the combustible component, broadly between about 0.5 and about 80 mol percent methane in the combustible component, but more generally the combustible component contains between about 5 and about 50 mol percent methane. The combustible component also broadly contains between about 10 and about 75 mol percent carbon monoxide, between about 0 and about 50 mol percent hydrogen and from zero to about 50 mol percent aliphatic hydrocarbons having from two to about six carbon atoms. More generally the amount of carbon monoxide in the combustible component is between about 15 and about 50 mol percent, the amount of hydrogen between about 10 and 30 mol percent and the amount of the lower aliphatic hydrocarbons being up to about 25 mol percent. The non-combustible component is generally nitrogen, carbon dioxide or a mixture of these two gases, and it may frequently contain water vapor.

Hydrogen sulfide will form sulfur dioxide as a combustion product which is itself controlled as a pollutant, therefore, its significant presence in the low heating value gas is undesired. The presence of hydrogen sulfide affects the catalyzed combustion reaction in several respects resulting in undesired effects including a lowering in the overall conversion of the hydrocarbons and an increase in the temperature required for the maintenance of continuous combustion. For these reasons, the amount of hydrogen sulfide in the gas stream undergoing substoichiometric combustion is desirably no more than about two weight percent and preferably a maximum of about 0.5 weight percent. Additionally, it is desired that the hydrogen sulfide, if present, be a very minor amount of the combustible component. Desirably the hydrogen sulfide is less than ten percent of the combustible component and more desirably less than five percent of the combustible component. In many instances the hydrogen sulfide is less than one percent of the combustible component.

A supported platinum catalyst is preferred as the oxidation catalyst in our substoichiometric combustion process because platinum is both highly active as an oxidation catalyst and is also relatively sulfur tolerant. Other oxidation catalysts can also be used such as ruthenium, palladium, rhodium, osmium, iridium, vanadium, cobalt, nickel, iron, copper, manganese, chromium, molybdenum, titanium, silver, cerium, and the like. Suitable mixtures of these oxidation catalysts can also be used. A platinum and solid cocatalyst combination can be used of the type described in Patent No. 4,191,733 for further enhanced carbon monoxide suppression. The solid cocatalyst, as described, is selected from Groups II and VIIB, Group VIII up through atomic No. 46, the lanthanides, chromium, zinc, silver, tin and antimony.

The utilization of substoichiometric combustion of a low heating value gas may be desirable in certain circumstances, such as, for example, when the composition of the gas and therefore its heat content varies with time. The use of a constant substoichiometric amount of air for combustion results in a constant temperature in both the combustion zone and in the exiting combusted gas notwithstanding the variation in the heat content of the low heating value gas. The constant temperature in the combustion zone protects the oxidation catalyst against damage from cycles of thermally induced expansion and contraction, which can be a significant problem, particularly when large catalyst structures are required to handle very large volumes of low heating value gas. Furthermore, if this combusted gas of constant temperature is used to drive a gas turbine, the turbine blades are also protected against damage from thermal cycles, which is particularly desirable with gas turbines which are designed for constant temperature operation.

We find that the present process is suitable for combustion of low heating value gas streams having a heating value as low as about 15 Btu/scf (one British thermal unit per standard cubic foot at atmospheric pressure and 60° F., 15.6° C., equals 9.25 kilocalories per cubic meter) but we prefer that the heating value of the gas stream be at least about 30 Btu/scf. The maximum heating value of the gas stream undergoing combustion by our process broadly is about 200, more generally a maximum of about 150, and most likely contains a maximum of about 100 Btu/scf. Frequently the heating value of the gas fluctuates with time as measured in hours or days or even weeks. In the case of gas streams of fluctuating heating value, the heating value specified above means the average heating value over one or more cycles of fluctuation.

As used herein, air equivalence ratio, or A.E.R., is the ratio of the amount of air used in the partial combustion to the amount of air required at the same conditions of pressure and temperature for stoichiometric combustion of all combustible components in the gas stream (the denominator of this ratio being 1.0 is not expressed). In the substoichiometric cumbustion of these various low heating value gas streams, the air equivalence ratio will be at least about 0.20 and preferably at least about 0.35 with a maximum of about 0.95 and preferably a maximum of about 0.85. When the heating value of the gas fluctuates with time, the A.E.R. is based on the average heating value of the gas and in this instance it can be referred to as the overall or average A.E.R.

In combusting this low heating value gas and air mixture, it must be heated to its combustion, or light-off temperature, which depends on the particular composition of the gas, and the particular oxidation catalyst, prior to contacting the gas stream and the oxidation catalyst. After the combustion has been initiated and the combustion chamber and catalyst have been heated up, steady-state combustion can be continued at a temperature significantly lower than the light-off temperature.

The low heating value gas stream can be the liquids-free flue gas obtained from subterranean in situ combustion processes for the recovery of hydrocarbons from carbonaceous deposits such as petroleum reservoirs, tar sands, oil shale formations and the like. The hydrocarbon component in this flue gas subsequent to the recovery of condensibles, in general, will primarily be methane with decreasing amounts of the higher hydrocarbons up to about the six carbon hydrocarbons. Or the gas stream can be the flue gas resulting from the underground combustion and gasification of a coal deposit. The low heating value gas can also be obtained by the aboveground retorting of coal, shale and the like. Additionally, the gas stream can be a low heating value factory by-product gas stream such as those obtained in metallurgical and chemical operations, and the like. As used herein, the term higher aliphatic hydrocarbon refers to aliphatic hydrocarbons having from two to about six carbon atoms.

As described, the combustion process of our invention relates to the catalyzed combustion of low heating value gas streams with insufficient oxygen for complete combustion. It is also possible and generally desirable to preheat the gas stream if it is of such low heating value that it will not support combustion when it is at ambient temperature (that is about 25° C.), even in the presence of an oxidation catalyst. In this instance the preferred means of preheating the gas stream, either together with or in the absence of the air for combustion, is by heat exchange with the hot combusted gas stream. In a two-stage combustion process the waste gas stream is preferably preheated by exchange with the combusted gas exiting from the first stage.

The temperature of the combusted gas stream available for preheating is dependent on a number of factors including the heating value of the gas stream undergoing combustion, the amount of air that is used for combustion and the temperature to which the feed gas stream is preheated. The temperature to which the gas is preheated is not critical other than it be sufficiently high to support combustion under the particular conditions involved. The pressure present in the combustion zone also is not critical, varying from about atmospheric up to about 2,000 psi, more generally up to about 500 psi.

The oxidation catalyst that is used in our substoichiometric combustion process is desirably carried on an inert support. Since the catalytic combustion inherently involves a relatively large volume of the stream of low heating value gas, the support is preferably of a design to permit good solid-gas contact at relatively low pressure drop. A suitable support can be formed as a monolith with hexagonal cells in a honeycomb design. Other cellular, relatively open-celled designs are also suitable.

The support for the catalysts to be used in the process of this invention can be any of the refractory oxide supports well known in the art, such as those prepared from alumina, silica, magnesia, thoria, titania, zirconia, silica-aluminas, silica-zirconias, magnesia-aluminas, and the like. Other suitable supports include the naturally occurring clays, such as diatomaceous earth. Additional desirable supports for use herein are the more recently developed corrugated ceramic materials made, for example, from alumina, silica, magnesia, and the like. An example of such material is described in U.S. Pat. No. 3,255,027 and is sold by E. I. duPont de Nemours & Company as Torvex. More recently, metallic monoliths have been fabricated as catalyst supports and these may be used to mount the catalytic material. An example of these supports is Fecralloy manufactured by Matthey Bishop, Inc. under U.S. Pat. Nos. 3,298,826 and 3,920,583.

If desired, the catalyst and cocatalyst, if used, can be mounted directly onto the surface of the monolith. Or the monolith can first be coated with a refractory oxide, such as defined above, prior to the deposition of these materials. The addition of the refractory oxide coating allows the catalyst to be more securely bound to the monolith and also aids in its dispersion on the support. These coated monoliths possess the advantage of being easily formed in one piece with a configuration suitable to permit the passage of the combustion gases with little pressure drop. The surface area of the monolith generally is less than one square meter per gram. However, the coating generally has a surface area of between about ten and about 300 $m^2/g$. Since the coating is generally about ten percent of the coated support, the surface area of the coated support will therefore generally be between about one and about 30 $m^2/g$.

In preparing the platinum and cocatalyst combination it is preferred that the cocatalyst be placed on the support before the platinum. However, the reverse order of emplacement is also suitable or the platinum and cocatalyst can be added in a single step. In the preferred procedure a suitable salt of the cocatalyst metal is dissolved in a solvent, preferably water. The support is impregnated with the solution of the cocatalyst metal. In a preferred embodiment the impregnated support is next gassed with a suitable gas, generally ammonia or hydrogen sulfide, to cause the catalyst metal to precipitate uniformly on the support as the hydroxide or sulfide as the case may be. It is then dried and calcined in air at about 800° to 1200° F., preferably at about 1000° F. Hydrogen may be used to reduce the cocatalyst compound to the metal if desired.

Platinum is impregnated onto the support, either alone or in association with a cocatalyst as an aqueous solution of a water-soluble compound such as chloroplatinic acid, ammonium chloroplatinate, platinum tetramine dinitrate, and the like. The catalyst is then gassed with hydrogen sulfide in a preferred embodiment to cause precipitation of the platinum as the sulfide to ensure uniform distribution of the platinum on the support. It is again dried and then calcined in air at about 800° to 1200° F., preferably at about 1000° F. The same general procedure can be used for the incorporation of a different oxidation catalyst on the support. In general, it is not certain whether calcination converts the catalyst metal sulfides and hydrated sulfides to another compound or how much is converted to the oxide, sulfite or sulfate, or to the metal itself. Nevertheless, for convenience, the noble metals such as platinum are reported as the metal and the other catalyst metals are reported as the oxide.

The supported catalyst is prepared so that it contains between about 0.005 and about 20 weight percent of the catalyst metal reported as the oxide, and preferably between about 0.1 and about 15 weight percent of the metal oxide. The platinum or other noble metal is used in an amount to form a finished supported catalyst containing between about 0.005 and about ten weight percent of the metal, and preferably about between 0.01 and about seven weight percent of the metal. When the platinum and cocatalyst combination is used for lowered carbon monoxide content in the product gas stream, the relative amount of the cocatalyst and the platinum has an effect on the combustion, including an effect in the amount of carbon monoxide in the combusted gas. The catalyst will broadly contain a mol ratio of cocatalyst as the oxide to platinum as the metal of between about 0.01:1 and about 200:1, preferably between about 0.1:1 and about 100:1, and most preferably between about 0.5:1 and about 50:1.

As pointed out above, a particular advantage of our invention is that a low heating value gas containing hydrogen, carbon monoxide and methane can be burned substoichiometrically to preferentially combust the carbon monoxide before the methane resulting in a relative lowering of the proportion of carbon monoxide and a relative increase in the proportion of methane in the product gas. This result may also be caused, in part, by a favorable shift in the equilibrium of the steam reforming reaction $CH_4+H_2O \rightleftharpoons CO+3H_2$ and the water gas shift reaction $CO+H_2O \rightleftharpoons CO_2+H_2$.

DESCRIPTION OF PREFERRED EMBODIMENTS

The reactor used in the following experiments, at atmospheric pressure was a one-inch I.D. forged steel unit which was heavily insulated to give adiabatic reaction conditions. The reactor used in the combustion under pressure was made from Incoloy 800 alloy (32 percent Ni, 46 percent Fe and 20.5 percent Cr) but was otherwise the same. The catalyst consisted of three one-inch monoliths wrapped in a thin sheet of a refractory material (Fiberfrax, available from Carborundum Co.). The catalyst compositions, as specified, are only approximate because they are based on the composition of the impregnating solution and the amount absorbed and are not based on a complete chemical analysis of the finished catalyst. Well insulated preheaters were used to heat the gas stream before it was introduced into the reactor. The temperatures were measured directly before and after the catalyst bed to provide the inlet and outlet temperatures. An appropriate flow of preheated nitrogen and air was passed over the catalyst until the desired feed temperature was obtained.

EXAMPLES 1-8

A catalyst was made containing about 0.3 percent platinum on a Torvex support. The support was a mullite ceramic in the shape of a honeycomb having a coating of alumina of about 25 $m^2/g$ surface area. The support was soaked in an aqueous solution of chloroplatinic acid containing 23 mg of platinum per ml for 15 minutes. After removing excess solution from the support material, it was gassed with hydrogen sulfide for about 30 minutes to precipitate the platinum as platinum sulfide. The catalyst was then dried at 120° C. and calcined at 1000° F. (538° C.). A second, bimetallic catalyst containing about one percent cobalt oxide and about 0.3 percent platinum was prepared in the same manner except that cobalt was impregnated onto the support using an aqueous cobalt nitrate solution followed by gassing with hydrogen sulfide and calcination in air prior to the incorporation of the platinum onto the support.

A series of experiments were conducted in the reactor using these two catalysts and two low heating value gas streams having the composition set out in Table I.

TABLE I

| Component | Feed A,mol % | Feed B,mol % |
|---|---|---|
| hydrogen | 3.65 | 5.03 |
| carbon monoxide | 3.52 | 2.99 |
| methane | 2.19 | 1.92 |
| ethane | 1.12 | 0.47 |
| propane | 0.23 | 0.24 |
| carbon dioxide | 10.90 | 10.96 |
| nitrogen | 74.35 | 74.35 |
| water | 4.0 | 4.0 |
| sulfur dioxide | 0.04 | 0.04 |
| | 100.00 | 100.00 |
| Heating value,Btu/scf | 71 | 59 |

The feed gas was pretreated and then introduced into the reactor at a gas hourly space velocity of 21,000 per hour on an air-free basis and combustion was allowed to proceed until steady state conditions were reached. The experiments were conducted at atmospheric pressure or at a slightly elevated pressure. The analyses were made after steady state conditions were reached on a water-free basis. No measurable free oxygen occurred in the product gas stream. Separate analysis of the product gas resulting from several of the experiments showed that the hydrogen was substantially completely consumed at an A.E.R. of about 0.2 and completely consumed at an A.E.R. of about 0.5. The results of these experiments are set out in Table II on a hydrogen-free basis. In this Table Examples 1-6 used the cobalt oxide/platinum catalyst and Examples 7 and 8 used the platinum catalyst.

TABLE II

| | | Temperature, °F. | | Product analysis, mol % | | | | |
|---|---|---|---|---|---|---|---|---|
| Example | Feed | Inlet | Exit | CO | $CH_4$ | $C_2H_6$ | $C_3H_8$ | $CO_2$ |
| 1 | A | 600 | 923 | 2.45 | 2.21 | 1.08 | 0.26 | 10.91 |
| 2 | B | 570 | 912 | 2.33 | 3.04 | 0.50 | 0.23 | 10.63 |
| 3 | A | 600 | 1050 | 2.23 | 2.08 | 0.81 | 0.15 | 10.83 |
| 4 | A | 600 | 1154 | 2.14 | 1.93 | 0.51 | 0.09 | 10.97 |
| 5 | A | 500 | 1234 | 1.64 | 1.53 | 0.33 | 0.05 | 11.34 |
| 6 | B | 530 | 1175 | 0.92 | 1.94 | 0.20 | 0.04 | 10.68 |
| 7 | B | 570 | 894 | 2.39 | 2.93 | 0.46 | 0.22 | 10.13 |

TABLE II-continued

| | | Temperature, °F. | | Product analysis, mol % | | | | |
|---|---|---|---|---|---|---|---|---|
| Example | Feed | Inlet | Exit | CO | $CH_4$ | $C_2H_6$ | $C_3H_8$ | $CO_2$ |
| 8 | B | 530 | 1189 | 2.25 | 1.64 | 0.15 | — | 10.00 |

EXAMPLES 9-12

A second series of combustion experiments were carried out using a different feed stream and the same two catalyst compositions that were used in the previous examples plus two different bimetallic catalysts. The composition of the feed stream is set out in Table III.

TABLE III

| Component | Mol % |
|---|---|
| carbon monoxide | 2.89 |
| methane | 2.11 |
| ethane | 0.31 |
| propane | 0.29 |
| nitrogen | 94.36 |
| sulfur dioxide | 0.04 |
| | 100.00 |
| Heating value, Btu/scf | 43 |

The combustion experiments were carried out in the same manner as above except that the gas was fed to the reactor at a gas hourly space velocity of 42,000 per hour on an air-free basis. One of the new catalysts contained about one percent antimony oxide and about 0.3 percent platinum. The other new catalyst contained about one percent calcium oxide and about 0.3 percent platinum. The results of these experiments are set out in Table IV in which the analyses were determined on a dry basis.

TABLE IV

| Example | 9 | 10 | 11 | 12 |
|---|---|---|---|---|
| Catalyst | Pt | CoO-Pt | $Sb_2O_3$-Pt | CaO-Pt |
| A.E.R. | 0.51 | 0.51 | 0.51 | 0.43 |
| Temperature, °F. | | | | |
| inlet | 663 | 665 | 663 | 673 |
| exit | 1198 | 1223 | 1243 | 1078 |
| Product analysis, mol % | | | | |
| carbon monoxide | 0.59 | 0.57 | 0.26 | 0.22 |
| methane | 1.27 | 1.34 | 1.50 | 1.77 |
| ethane | 0.12 | 0.12 | 0.13 | 0.23 |
| propane | 0.05 | 0.04 | 0.05 | 0.10 |
| carbon dioxide | 2.92 | 2.97 | 3.19 | 2.65 |

As stated, the heating value of the gas may vary with time. For example, in an underground combustion process the heating value of the liquids-free flue gas may vary from hour to hour to give a minimum heating value of 60 Btu/scf and a peak heating value of 82 Btu/scf over a 24 hour period for a cumulative average heating value of 72 Btu/scf. In the combustion of a gas of varying heating value with a constant stream of combustion air for the purpose of driving a gas turbine, it is preferred that the air equivalence ratio be so selected that there is not a substantial excess of oxygen at any specific period of operation, i.e., at minimum heating value, in order to ensure that there is not a substantial drop in temperature of the combusted gas that is fed to the turbine. If the variations in heating value over a period of time exhibit a substantial swing between the minimum and maximum values, it may be expedient to inject supplemental fuel into the feed gas stream during minimum values to decrease the extent of the negative swing and thereby avoid a decrease in the product gas temperature during this period of operation.

In using the low heating value gas to drive a gas turbine, the combusted gas must enter the gas turbine at a sufficient pressure for satisfactory operation of the gas turbine. In general, an inlet pressure of at least about 75 psig or higher is desirable. This pressure can be obtained, if necessary, by compressing the gas fed to the combustion furnace. A gas turbine can be operated at a temperature as low as about 1,000° F. or even lower, but since efficiency exhibits a significant drop at the lower temperatures, it is preferred to operate at a temperature at which significant efficiency is obtained, and particularly a temperature of at least about 1,200° F. The maximum temperature is determined by the temperature resistance of the materials from which the turbine is constructed and can be about 2,000° F. or even higher particularly if the compressor is designed with provision for auxiliary cooling but it is preferred that the maximum operating temperature be about 1,800° F. Generally, a large capacity turbine of the type which would be used with large gas volumes is designed for optimum operation within a specific restricted temperature range.

In a two-stage combustion procedure, it is desirable if at least about one-third of the total air which is to be used in the substoichiometric combustion be added in one combustor, and it is generally preferred that about one-half of this combustion air be added in each combustor. This variation in the amount of combustion air added to each combustor permits the temperature of the gas stream, entering the first stage reactor following heat exchange with the combusted gas from the first stage, to be varied. This air that is used for combustion of the gas, as well as any air that may be used for cooling the combusted gas down to the desired turbine operating temperature, needs to have a pressure only moderately higher than the pressure of the gas streams into which it is injected. The turbine may be used to drive an air compressor for use in a subterranean combustion procedure for driving an electric power generator or for other desired equipment.

It is to be understood that the above disclosure is by way of specific example and that numerous modifications and variations are available to those of ordinary skill in the art without departing from the true spirit and scope of the invention.

We claim:

1. A method for the recovery of energy from a gas stream having an average heating value in the range of about 15 to about 200 Btu/scf and having a combustible component comprising from about 0.5 to about 80 mol percent methane, from about 10 to about 75 mol percent carbon monoxide, from about 0 to about 50 mol percent hydrogen and from about 0 to about 50 mol percent aliphatic hydrocarbons having from two to about six carbon atoms, which comprises the steps passing said gas stream admixed with air for combustion in contact with an oxidation catalyst in one or more combustion zones, at an overall average air equivalence ratio of between about 0.2 and about 0.95 and at a temperature high enough to initiate and maintain combustion of said gas stream, utilizing the heat energy produced in said gas stream by said combustion and discharging the incompletely combusted gas stream into the atmosphere.

2. A method for the recovery of energy from a gas stream in accordance with claim 1 in which the heating value of the gas is between about 30 and about 150 Btu/scf.

3. A method for the recovery of energy from a gas stream in accordance with claim 1 in which the combustible component comprises from about 5 to about 50 mol percent methane, from about 15 to about 50 mol percent carbon monoxide, from about 10 to about 30 mol percent hydrogen and from about 0 to about 25 mol percent aliphatic hydrocarbons having from two to about six carbon atoms.

4. A method for the recovery of energy from a gas stream in accordance with claim 3 in which the heating value of the gas is between about 30 and about 100 Btu/scf.

5. A method for the recovery of energy from a gas stream in accordance with claim 1 in which the gas stream contains up to about 0.5 weight percent hydrogen sulfide.

6. A method for the recovery of energy from a gas stream in accordance with claim 3 in which the air equivalence ratio is between about 0.35 and about 0.85.

7. A method for the recovery of energy from a gas stream in accordance with claim 1 in which the catalyst contains between about 0.005 and about ten weight percent platinum on a support.

8. A method for the recovery of energy from a gas stream in accordance with claim 3 in which the catalyst contains between about 0.01 and about seven weight percent platinum on a support.

9. A method for the recovery of energy from a gas stream in accordance with claim 1 in which the air is added for combustion at a substantially constant rate with time.

10. A method for the recovery of energy from a gas stream in accordance with claim 9 in which the heating value of the gas stream varies with time.

11. A method for the recovery of energy from a gas stream in accordance with claim 10 in which the air feed rate will not result in a substantial stoichiometric excess of air during a period of minimum heating value.

12. A method for the recovery of energy from a gas stream in accordance with claim 1 in which the gas stream to the combustion zone is heated to combustion temperature by heat exchange with the combusted gas.

13. A method for the recovery of energy from a gas stream in accordance with claim 1 in which the gas stream following combustion is expanded in a gas turbine for the delivery of mechanical energy.

14. A method for the recovery of energy from a gas stream in accordance with claim 15 in which the pressure of the combusted gas stream fed to the gas turbine is at least about 75 psig.

15. A method for the recovery of energy from a gas stream in accordance with claim 1 in which the said gas stream and a portion of the air required for partial combustion is passed in contact with each of two oxidation catalysts in series in two stages.

16. A method for the recovery of energy from a gas stream in accordance with claim 15 in which at least one-third of said combustion air is added to the gas stream prior to combustion in each stage.

17. A method for the recovery of energy from a gas stream in accordance with claim 16 in which about fifty percent of said combustion air is added prior to each stage.

* * * * *